US009326909B2

(12) United States Patent
Liu et al.

(10) Patent No.: US 9,326,909 B2
(45) Date of Patent: May 3, 2016

(54) PORTABLE HAND REHABILITATION DEVICE

(71) Applicant: The University of Tennessee Research Foundation, Memphis, TN (US)

(72) Inventors: Yu Liu, Memphis, TN (US); Randall J. Nelson, Germantown, TN (US)

(73) Assignee: University Of Tennessee Research Foundation, Knoxville, TN (US)

( * ) Notice: Subject to any disclaimer, the term of this patent is extended or adjusted under 35 U.S.C. 154(b) by 511 days.

(21) Appl. No.: 13/892,269

(22) Filed: May 11, 2013

(65) Prior Publication Data

US 2013/0303951 A1 Nov. 14, 2013

Related U.S. Application Data

(60) Provisional application No. 61/645,682, filed on May 11, 2012.

(51) Int. Cl.

| | |
|---|---|
| ***A61H 1/02*** | (2006.01) |
| ***A61H 23/00*** | (2006.01) |
| ***A63B 71/06*** | (2006.01) |

(Continued)

(52) U.S. Cl.

CPC ..... *A61H 1/0285* (2013.01); *A61H 1/0288* (2013.01); *A61H 23/00* (2013.01); *A63B 21/4019* (2015.10); *A63B 22/00* (2013.01); *A63B 23/16* (2013.01); *A63B 71/0622* (2013.01); *A63B 69/0053* (2013.01); *A63B 2022/0092* (2013.01); *A63B 2022/0094* (2013.01); *A63B 2071/0655* (2013.01);

(Continued)

(58) Field of Classification Search

CPC ... A61H 23/00; A61H 23/02; A63B 21/4019; A63B 23/16

See application file for complete search history.

(56) References Cited

U.S. PATENT DOCUMENTS

| | | | |
|---|---|---|---|
| 4,558,704 | A | 12/1985 | Petrofsky |
| 5,601,529 | A | 2/1997 | Wollman |

(Continued)

FOREIGN PATENT DOCUMENTS

| | | |
|---|---|---|
| EP | 1974710 | 10/2008 |
| WO | WO 2010/033055 | 3/2010 |

OTHER PUBLICATIONS

PCT International Preliminary Report on Patentability issued Nov. 11, 2014.

(Continued)

*Primary Examiner* — Justine Yu
*Assistant Examiner* — Kathrynn Lyddane
(74) *Attorney, Agent, or Firm* — Peter L. Brewer; Baker Donelson IP

(57) ABSTRACT

A therapeutic device for improving voluntary control of paretic muscles in a patient extremity is provided. The therapeutic device is designed to be portable and may be strapped onto a patient's wrist or ankle. The device employs a plurality of micro-motors configured to deliver vibratory sensations to a patient extremity as somatosensory inputs. Each micro-motor is dimensioned to reside on a patient's respective finger or along their foot. The therapeutic device also includes a micro-processor programmed to actuate the micro-motors for designated times and in pre-programmed sequences, and a housing containing the micro-processor. A method of using somatosensory input as a functional guidance to improve motor function in a patient extremity is also provided.

27 Claims, 9 Drawing Sheets

(51) Int. Cl.
*A63B 22/00* (2006.01)
*A63B 23/16* (2006.01)
*A63B 69/00* (2006.01)

(52) U.S. Cl.
CPC ..... *A63B2207/02* (2013.01); *A63B 2225/20* (2013.01); *A63B 2225/50* (2013.01)

(56) References Cited

U.S. PATENT DOCUMENTS

| | | | | |
|---|---|---|---|---|
| 6,748,604 | B2 * | 6/2004 | Duboff | A41D 19/00 2/160 |
| 6,878,122 | B2 | 4/2005 | Cordo | |
| 8,165,685 | B1 * | 4/2012 | Knutson | A61N 1/36003 607/2 |
| 8,998,831 | B2 * | 4/2015 | Sankai | A61B 5/04888 601/23 |
| 2010/0160834 | A1 * | 6/2010 | Fong | A61B 5/1118 600/595 |
| 2010/0160986 | A1 * | 6/2010 | Simmons | A61H 1/0237 607/3 |
| 2010/0249675 | A1 * | 9/2010 | Fujimoto | A61H 1/0285 601/40 |
| 2012/0157263 | A1 * | 6/2012 | Sivak | A61H 1/0285 482/4 |
| 2013/0072829 | A1 | 3/2013 | Fausti et al. | |
| 2013/0072836 | A1 * | 3/2013 | Heaton | A61H 1/0288 601/152 |

OTHER PUBLICATIONS

PCT Document: Notification of Transmittal of the International Search Report and the Written Opinion (Sep. 16, 2013) (2 pages).
PCT Document: International Search Report (Sep. 16, 2013) (4 pages).
PCT Document: Written Opinion of the International Searching Authority (Sep. 16, 2013) (4 pages).
Mountcastle, Vernon B., Talbot, William H., Sakata, Hideo and Hyvarinen, Juhani. "Cortical Neuronal Mechanisms in Flutter-Vibration Studied in Unanesthetized Monkeys. Neuronal Periodicity and Frequency Discrimination." Journal of Neurophysiology 1969. 452-84.
Horsley, Victor. "The So-Called Motor Area." British Medical Journal 1909. 121-32.
Sasaki, K. and Gemba, H. "Compensatory Motor Function of the Somatosensory Cortex for the Motor Cortex Temporarily Impaired by Cooling in the Monkey." Experimental Brain Research 1984. 60-68.
Sasaki, K. and Gemba, H. Compensatory Motor Function of the Somatosensory Cortex for Dysfunction of the Motor Cortex Following Cerebellar Hemispherectomy in the Monkey. Experimental Brain Research 1984. 532-38.
Crapse, Trinity B. and Sommer, Marc A. "Corollary Discharge Circuits in the Primate Brain." Current Opinion in Neurobiology 2008. 552-57.
Nelson, Randall J. "Interactions between Motor Commands and Sometic Perception in Sensorimotor Cortex." Current Opinion in Neurobiology1996. 801-10.
Galazky. Imke, Schütze, Hartmut, Nosesselt, Toemme, Hopf, Jens-Max, Heinze, Hans-Jochen and Schoenfeld, Mircea Ariel, Attention to Somatosensory Events is Directly Linked to the Preparation for Action, Journal of the Neurological Sciences 2009. 93-98.
Gosselin-Kessiby, N., Messier, J. and Kalaska, J.F. "Evidence for Automatic On-Line Adjustments of Hand Orientation During Natural Reaching Movements to Stationary Targets." Journal of Neurophysiology 2008. 1653-71.
Gosselin-Kessiby N., Kalaska, John F. and Messier, Julie. "Evidence for a Proprioception-Based Rapid On-Line Error Correction Mechanism for Hand Orientation During Reaching Movements in Blind Subjects." Journal of Neuroscience 2009. 3485-96.
Gritsenko V., Krouchev, N.I. and Kalaska, J.F. "Afferent Input, Efference Copy, Signal Noises, and Biases in Perception of Joint Angle During Active Versus Passive Elbow Movements." Journal of Neurophysiology 2007. 1140-54.
Gritsenko, V., Yakovenko, S. and Kalaska, J.F. "Integration of Predictive Feedforward and Sensory Feedback Signals for Online Control of Visually Guided Movement." Journal of Neurophysiology 2009. 914-30.
O'Doherty, Joseph E., Lebedev, Mikhail A., Hanson, Timothy L., Fitzsimmons, Nathan A. and Nicolelis. "A Brain-Machine Interface Instructed by Direct Intracortical Microstimulation." Frontiers in Integrative Neuroscience 2009. 1-10.
Raos, Vassilis, Evangeliou, Mina N. and Savaki, Helen E. "Mental Stimulation of Action in the Service of Action Perception." Journal of Neuroscience 2007. 12675-83.
Vidoni, Eric D. and Boyd, Lara A. "Preserved Motor Learning after Stroke is Related to the Degree of Proprioceptive Deficit." Behavioral and Brain Functions 2009. 1-10.
Bolton, D.A.E. and Misiaszek J.E. "Contribution of Hindpaw Cutaneous Inputs to the Control of Lateral Stability During Walking in Cat." Journal of Neurophysiology 2009. 1711-24.
Bunday, Karen L. and Bronstein, Adolfo M. "Locomotor Adaptation and Aftereffects in Patients With Reduced Somatosensory Input Due to Peripheral Neuropathy." Journal of Neurophysiology 2009. 3119-28.
Widener, Gail L. and Cheney, Paul D. "Effects of Muscle Activity From Microstimuli Applied to Somatosensory and Motor Cortex During Voluntary Movement in the Monkey." Journal of Neurophysiology 1997. 2446-65.
Chen, Anthony J.-W. and D'Esposito, Mark "Traumatic Brain Injury: From Bench to Bedside to Society." Neuron 2010. 11-14.
Kolb, Bryan, Brown, Russell, Witt-Lajeunesse, Alane and Gibb, Robbin "Neural Compensations After Lesion of the Cerebral Cortex." Neural Plasticity 2001. 1-16.
McNeal, David W., Darling, Warren G., Ge, Jizhi, Stilwell-Morecraft, Kimberly S., Solon, Kathryn M., Hynes, Stephanie M., Pizzimenti, Marc A., Rotella, Diane L., Vanadurongvan, Tyler and Morecraft, Robert J. "Selective Long-Term Reorganization of the Corticospinal Projection From the Supplementary Motor Cortex Following Recovery From Lateral Motor Cortex Injury." Journal of Comparative Neurology 2010. 586-621.
Nudo, Randolph J. "Recovery after Damage to Motor Cortical Areas." Current Opinion in Neurobioly 1999. 740-47.
Dobkin, Bruce H. "Motor Rehabilitation after Stroke, Traumatic Brain, and Spinal Cord Injury: Common Denominators with Recent Clinical Trials." Current Opinion in Neurology 2009. 563-69.
Langhorne, Peter, Coupar, Fiona and Pollock, Alex "Motor Recover After Stroke: A Systematic Review." Lancet Neurology 2009. 741-54.
Moucha, Raluca and Kilgard, Michael P. "Cortical Plasticity and Rehabilitation." Progress in Brain Research 2006. 111-22.
Höffken, Oliver, Veit, Mathias, Knossalla, Frauke, Lissek, Silke, Bliem, Barbara, Ragert, Patrick, Dinse, Hubert R. and Tegenthoff, Martin "Sustained Increase of Somatosensory Cortex Excitability by Tactile Coactivation Studies by Paired Median Nerve Stimulation in Humans Correlates with Perceptual Gain." Journal of Physiology 2007. 463-71.
Koesler, I.B.M., Dafotakis, M., Ameli, M., Fink, G.R. and Nowak, D.A. Journal of Neurology, Neurosurgery & Psychiatry 2009. 614-19.
Lissek, Silke, Wilimzig, Claudia, Stude, Philipp, Pleger, Burkhard, Kalisch, Tobias, Maier, Christoph, Peters, Sören A., Nicolas, Volkmar, Tegenthoff, Martin and Dinse, Hubert R. "Immobilization Impairs Tactile Perception and Shrinks Somatosensory Cortical Maps." Current Biology 2009. 837-42.
Jones, Theresa A., Allred, Rachel P., Adkins, DeAnna L., Hsu, J. Edward, O'Bryant, Amber and Maldonado, Monica A. "Remodeling the Brain With Behavioral Experience After Stroke." Stroke 2009. S136-38.
Oujamaa, L., Relave, I., Froger, J., Mottet, D. and Pelissier, J.-Y., "Rehabilitation of Arm Function After Stroke." Annals of Physical Rehabilitation Medicine 2009. 269-95.
Thiel, Alexander, Aleksic, Beatrice, Klein, Johannes Ch., Rudolf, Jobst, and Heiss, Wolf-Dieter "Changes in Proprioceptive Systems

(56) References Cited

OTHER PUBLICATIONS

Activity During Recovery from Post-Stroke Hemiparesis." Journal of Rehabilitation Medicine 2007. 520-25.
Maldonado, Monica A., Allred, Rachel P., Felthauser, Erik L. and Jones, Theresa A. "Motor Skill Training, but not Voluntary Exercise, Improves Skilled Reaching After Unilateral Ischemic Lesions of the Sensorimotor Cortex in Rats." Neurorehabilitation Neural Repair Journal 2008. 250-61.
Cramer, Steven C. and Riley, Jeff D. "Neuroplasticity and Brain Repair After Stroke." Current Opinion in Neurology 2008. 76-82.
Floel, Agnes and Cohen, Leonardo G. "Translational Studies in Neurorehabilitation: from Bench to Bedside." Cognitive and Behavioral Neurology 2006. 1-10.
O'Dell, M.W., Lin, Chi-Chang David and Harrison, Victoria "Stroke Rehabilitation: Strategies to Enhance Motor Recovery." Annual Review of Medicine 2009. 55-68.
Taub, Edward, Uswatte, Gitendra and Elbert, Thomas "New Treatments in Neurorehabilitation Founded on Basic Research." Nature Reviews Neuroscience 2002. 228-36.
Albanese, M.-C., Duerden, E.G., Bohotin, V. and Duncan, G.H. "Differential Effects of Cognitive Demand on Human Cortical Activation Associated with Vibrotactile Stimulation." Journal of Neurophysiology 2009. 1623-31.
Burton, H., Abend, N.S., MacLeod, A.-M.K., Sinclair, R.J., Snyder, A.Z. And Raichle, M.E. "Tactile Attention Tasks Enhance Activation in Somatosensory Regions of Parietal Cortex: A Positron Emission Tomography Study." Cerebral Cortex1999. 662-74.
Johansen-Berg, Heidi, Christensen, Vasthi, Woolrich, Mark and Matthews, Paul M. "Attentions to Touch Modulates Activity in Both Primary and Secondary Somatosensory Areas." NeuroReport 2000. 1237-41.
Staines, W. Richard, Graham, Simon J., Black, Sandra E. and McIlroy, William E. "Task-Relevant Modulation of Contralateral and Ipsilateral Primary Somatosensory Cortex and the Role of a Prefrontal-Cortical Sensory Gating System." NeuroImage 2002. 190-99.
van Ee, Raymond, van Boxtel, Jeroen, J., Parker, Amanda L. and Alais, David. "Multisensory Congruency as a Mechanism for Attentional Control over Perceptual Selection." Journal of Neuroscience 2009. 11641-49.
Ito, Takayuki and Ostry, David J. "Somatosensory Contribution to Motor Learning Due to Facial Skin Deformation." Journal of Neurophysiology 2010. 1230-38.
Milot , Marie-Hélène, Marchal-Crespo, Laura, Green, Christopher S., Cramer, Steven C. and Reinkensmeyer, David J. "Comparison of Error-Amplification and Haptic-Guidance Training Techniques for Learning of a Timing-Based Motor Task by Healthy Individuals." Experimental Brain Research 2010. 119-31.
Fong, Kenneth N., Lo, Pinky C., Yu, Yoyo S., Cheuk, Connie K., Tsang, Toto H., Po, Ash S. and Chan, Chetwyn C. "Effects of Sensory Cueing on Voluntary Arm Use for Patients With Chronic Stroke: A Preliminary Study." Archives of Physical Medicine and Rehabilitationl 2011. 15-23.
Arya, Kamal Narayan, Verma, Rejesh, Garg, R.K., Sharma, V.P., Agarwal, Monika and Aggarwal, G.G. "Meaningful Task-Specific Training (MTST) for Stroke Rehabilitation: A Randomized Controlled Trial." Top Stroke Rehabilitation 2012. 193-211.
Weiss, Erica J. and Flanders, Martha "Somatosensory Comparison during Haptic Tracing." Ceberal Cortex 2011. 425-34.
Liu, Yu and Rouiller, Eric M. "Mechanisms of Recovery of Dexterity following Unilateral Lesion of the Sensorimotor Cortex in Adult Monkeys." Experimental Brain Research 1999. 149-59.
Liu, Yu, Denton, John M. and Nelson, Randall J. "Neuronal Activity in Monkey Primary Somatosensory Cortex is Related to Expectation of Somatosensory and Visual Go-Cues." Experimental Brain Research 2007. 540-50.
Liu, Yu, Denton, John M. and Nelson, Randall J. "Monkey Primary Somatosensory Cortical Activity During the Early Reaction Time Period Differs with Cues that Guide Movements." Experimental Brain Research 2008. 349-58.
Liu, Y., Denton, J.M. and Nelson, R.J. "Neuronal Activity in the Areas of Primary Somatosensory Cortex (SI) Varies When Monkeys Wait for Somatosensory and Visual Inputs to Guide Wrist Movements." The 40th Annual Meeting of the Society for Neuroscience 2010. San Diego, CA. Nov. 13-17.

* cited by examiner

PORTABLE HAND REHABILITATION DEVICE

CROSS REFERENCE TO RELATED APPLICATIONS

This application claims the benefit of U.S. Ser. No. 61/645,682 filed as a provisional application on May 11, 2012. That application was entitled "Portable Hand Rehabilitation Device," and is incorporated herein in its entirety by reference.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

1. Field of the Invention

The present invention relates to rehabilitative devices. More specifically, the invention relates to a portable device for enhancing motor function in paretic extremities, such as the hands of a stroke victim.

2. Technology in the Field of the Invention

Many individuals in the United States suffer from limited motor function in their extremities. This may be due to any of several causes. Some individuals may, for example, have suffered a stroke. The term "stroke" is a lay term that typically refers to a condition wherein the blood supply to an area of the brain is temporarily cut off. This is referred to as an "ischemic stroke."

In an ischemic stroke, a clot interrupts blood flow to a part of the brain. When blood fails to get through the brain, the oxygen supply to the affected area is cut of, causing brain cells to die. The longer the brain is without blood, the more severe the damage will be. Where the portion of the brain that controls movement of the upper extremities is damaged, the individual may be left in a state of partial paralysis, or paresis.

Some strokes are referred to as "hemorrhagic." A hemorrhagic stroke occurs when a blood vessel in the brain itself ruptures. This produces bleeding into the brain matter, causing damage to surrounding brain cells.

Regardless of the type, stroke is the most common cause of disability in the United States. There are approximately 650,000 new and 180,000 recurrent strokes each year in the United States. About a quarter of stroke survivors are considered permanently disabled. Stroke patient rehabilitation is a billion dollar industry in the United States.

Individuals may also lose function in one or more extremities as a result of an injury. Such injuries may occur due to a car accident, a diving accident, a fall, or other trauma. In these instances, the individual's cervical spine and nerves may be injured, again producing paresis in the hands. Additionally, such trauma can produce brain injury.

In addition to these events, some individuals may develop partial upper paralysis as a result of a medical condition. Examples of such conditions include amyotrophic lateral sclerosis (ALS), hypokalemic periodic paralysis, cerebral palsy, or other diseases. Finally, some individuals may suffer some degree of paresis due to brain injury caused by an explosion or accident incident to work or military duty.

When any of these conditions of partial paralysis occur, the individual is left with limited motor function in their arms. The most common disability among the numerous stroke survivors is weakness of the hand. Such individuals have difficulty performing routine tasks such as eating, turning off a light, manipulating a remote control, typing, or countless other activities that most people take for granted.

In many instances, individuals with limited motor function will undergo therapy. Such therapy may take place at a rehabilitation facility or at a medical office. Some patients undergo expensive rehab through the use of so-called robots. Such therapy tends to be expensive. In other instances, a daily regimen of home-based rehabilitation is prescribed to achieve hand and finger functional recovery. However, home-based programs are sometimes limited by the motivation of the patient and the patient's desire or ability to use proper techniques.

Therefore, a need exists for a hand rehabilitation device that will efficiently improve hand function in stroke patients and injury victims at home or other remote location. Further, a need exists for a home-based device that provides somatosensory, or touch-based, signals as functional guidance during rehabilitation. Still further, a need exists for a portable device that does not rely upon percutaneous electrical stimulation or implant and that engages the patient's brain.

BRIEF SUMMARY OF THE INVENTION

A portable rehabilitation device for chronic neurological disorders, including stroke and traumatic brain injuries, is provided herein. The device is used for patient therapy to improve control of paretic muscles in a patient extremity.

In one embodiment, the therapeutic device comprises a plurality of micro-motors. Each micro-motor is configured to deliver a vibratory sensation to selected extremity points. An example of extremity points is the patient's fingers. The micro-motors provide vibratory input to the extremity points.

Each micro-motor is dimensioned to reside on a patient's respective finger or, in one embodiment, along the patient's foot or toes. In one arrangement, five micro-motors are provided for each device, representing the usual number of digits on a patient's hand. In another arrangement, twelve micro-motors are provided. These represent one micro-motor on the dorsal side of each finger, one micro-motor on the ventral side of each finger, and a micro-motor positioned on each of the dorsal and ventral sides of the patient's wrist.

The device also includes a power source. The power source is in electrical communication with each of the micro-motors. The power source may be, for example, one or more batteries or a USB cable. In the latter instance, the USB cable may be plugged into a portable processing unit such as a laptop or a personal digital assistant. The processing unit, in turn, may be programmed to allow the patient or a health care provider to select a regimen of treatment to be delivered by the micro-motors.

The therapeutic device also includes a micro-processor, or controller. The micro-processor is programmed to actuate the micro-motors for designated times and sequences. The micro-processor may be pre-programmed to offer a variety of different times and sequences to increase patient interest and challenge. The micro-processor may communicate with each of the micro-motors through either a wired or through a wireless signal.

The device also includes a housing. The housing supports and protects the micro-processor and the batteries. The micro-processor may communicate with the batteries and the micro-motors through a printed circuit board. Where the micro-processor communicates with micro-motors wirelessly, then the housing will also include a transmitter for sending a wireless signal such as through the use of Blue Tooth or Wi-Max.

Preferably, the therapeutic device also has a power switch. The power switch allows the patient or a health care assistant to manually activate and de-activate the controller and micro-motors. This extends battery life. In addition, the therapeutic device also preferably includes a light source. The light source is arranged on the housing to deliver visual input to the patient when a micro-motor is vibrating.

In a preferred embodiment, each of the plurality of micro-motors is dimensioned to reside on a patient's finger. The device may then further include a glove for supporting each of the micro-motors adjacent to the patient's respective fingers. A strap may be provided for supporting the housing on the patient's wrist. The strap may be embedded in the glove. Alternatively, the housing is embedded in the glove itself without need of a separate strap. Alternatively still, no separate housing is used, but the micro-processor and associated electronics are embedded in the glove through so-called flex-electronics.

A method of using somatosensory input as a functional guidance to improve motor function in a patient extremity is also presented herein. In the method, the patient responds to both light and vibratory signals initiated by the controller. In this way, the patient receives somatosensory input guidance for motor tasks, requiring active brain engagement. Vibratory input combined with optional visual input provides go-cues and stop-cues for the patient.

The method includes securing a therapeutic device around a patient's wrist. The therapeutic device is constructed in accordance with the device described generally above, in its various embodiments. The method also includes initiating a first cycle of vibratory inputs from the micro-motors according to the programming of the micro-processor The method then includes monitoring patient movement of the extremity points in response to the vibratory inputs of the respective micro-motors.

BRIEF DESCRIPTION OF THE DRAWINGS

So that the manner in which the present invention can be better understood, certain illustrations, charts, photographs and/or flow charts are appended hereto. It is to be noted, however, that the drawings illustrate only selected embodiments of the inventions and are therefore not to be considered limiting of scope, for the inventions may admit to other equally effective embodiments and applications.

FIG. 2B(L) shows a unit that is used for a patient's left hand, while FIG. 2B(R) presents a unit that is used for a patient's right hand. In both units, wires are seen extending from the control units to respective micro-motors.

Figure 1A:
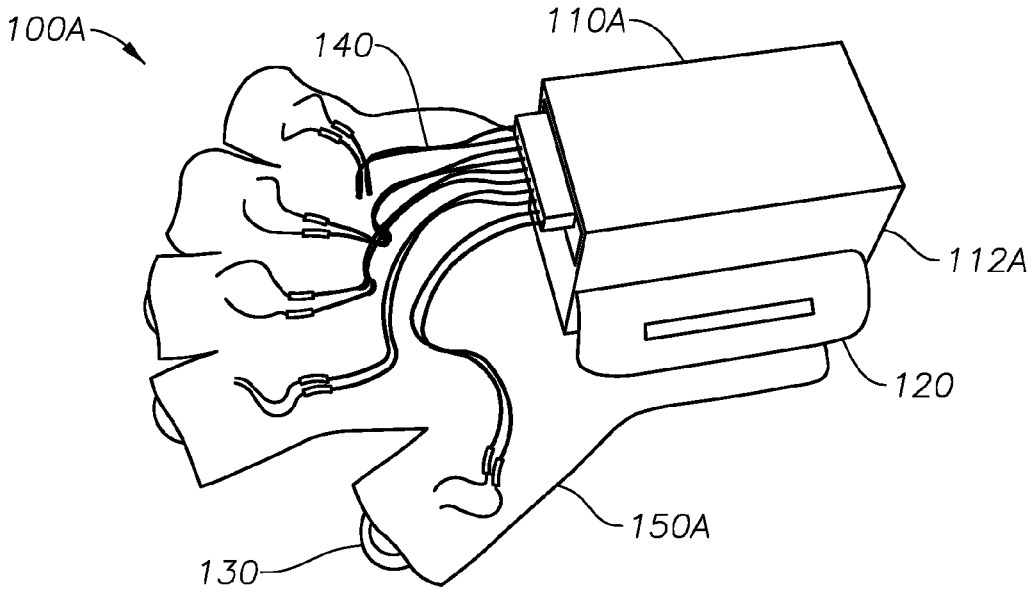
FIG. 1A is a perspective view of a portable hand rehabilitation device according to the present invention, in one embodiment. An illustrative control unit and glove are shown, along with wires extending from the control unit and into the glove.

The drawings designated as "A" and "B" represent the top and bottom portions of a micro-motor housing, respectively.

The drawing designated as "C" provides the bottom housing with a vibratory device resting therein.

The drawing designated as "D" shows the top and bottom portions of the housing connected together to form the micro-motor. The vibratory device and leads reside therein.

Figure 5:
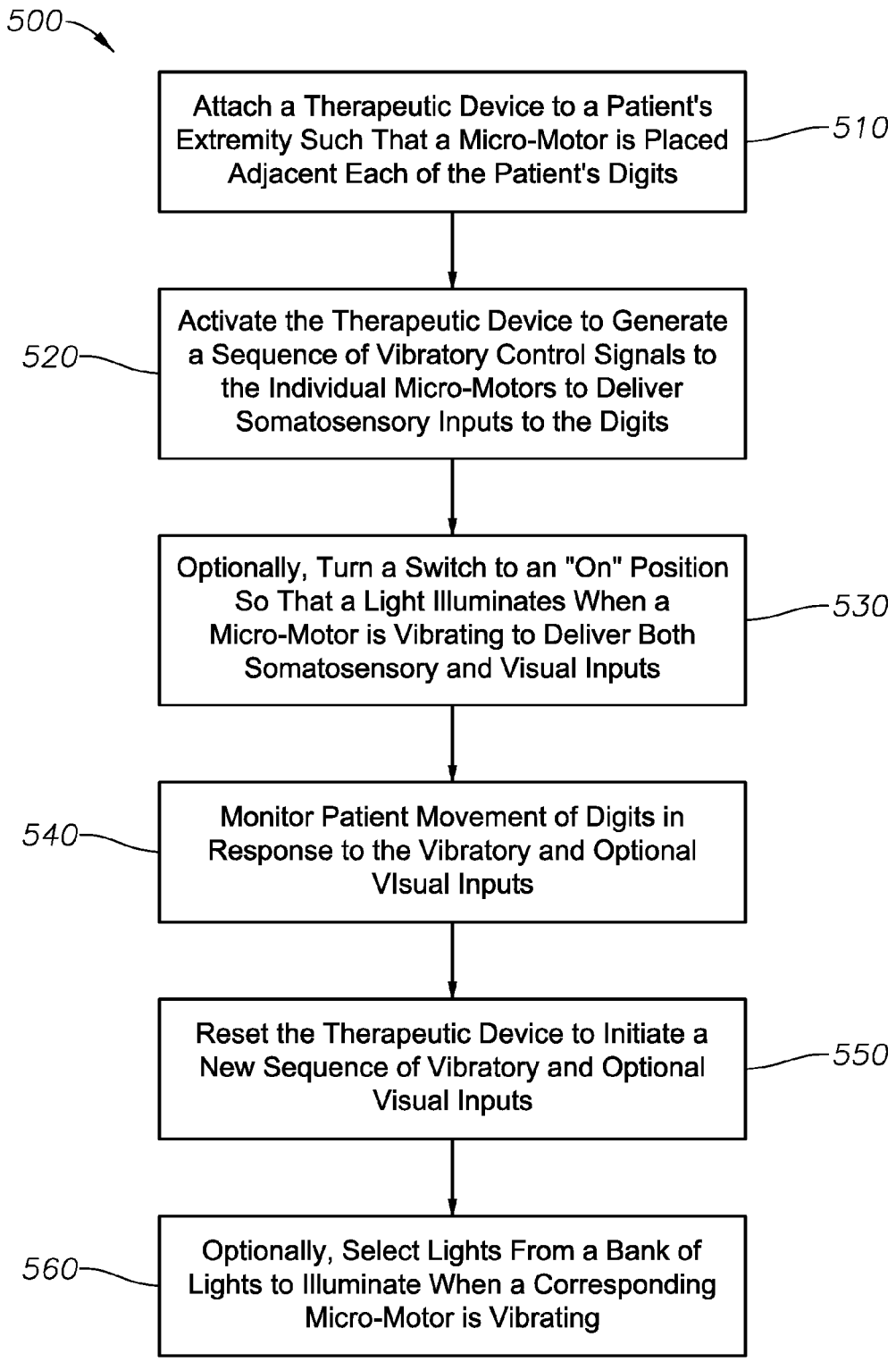

FIG. 5 is a flow chart showing steps for performing a method for providing neuro-electrical stimulation of a patient's upper extremities, in one embodiment. The method uses somatosensory input as a functional guidance to improve motor function.

Figure 6:
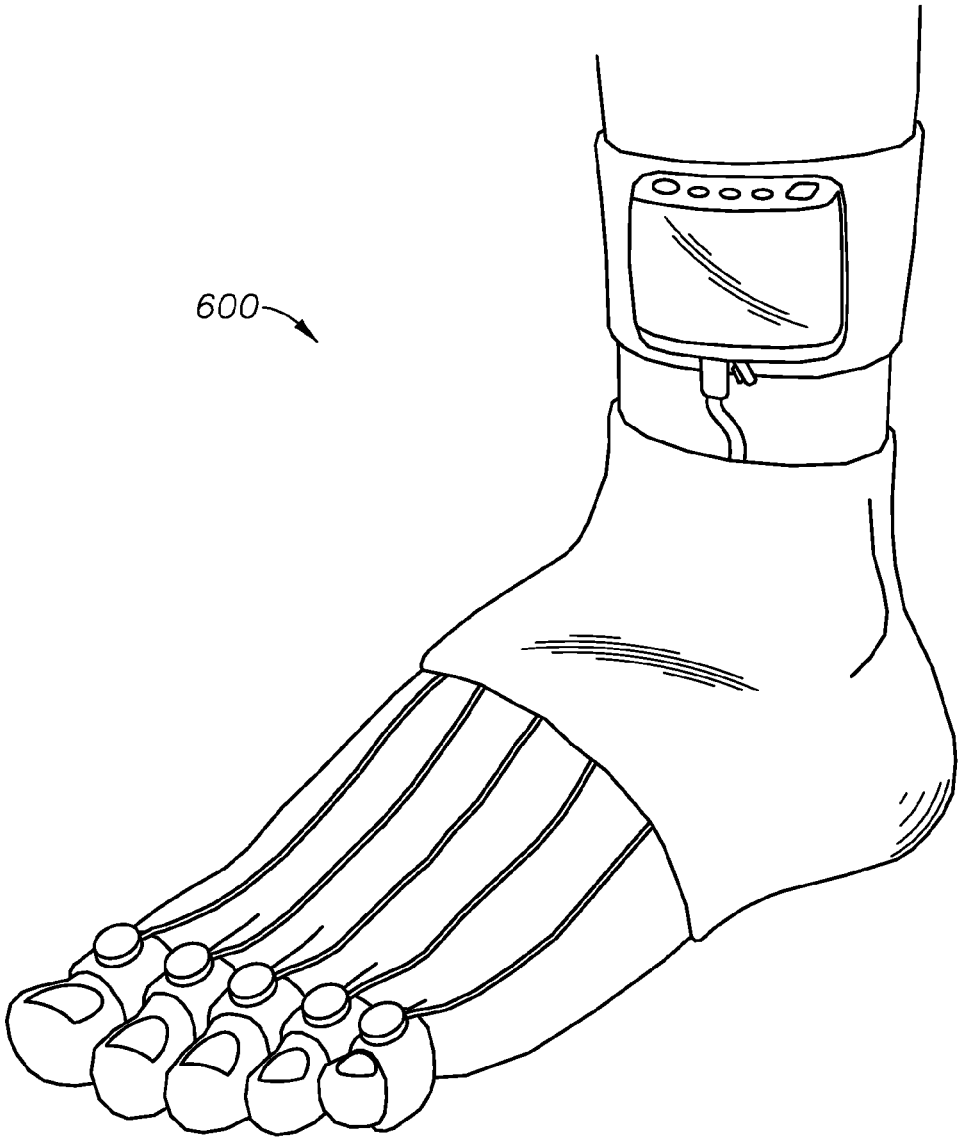

FIG. 6 is a perspective view of a portable rehabilitation device according to a second embodiment. Here, the device is configured to provide neuro-electrical stimulation of a patient's lower extremity.

DETAILED DESCRIPTION OF CERTAIN EMBODIMENTS

FIG. 1A is a perspective view of a portable rehabilitation device 100A according to the present invention, in one embodiment. The device 100A shown in the illustrative embodiment of FIG. 1A generally includes a control unit 110A. The control unit 110A defines a micro-processor (seen at 111 in FIG. 3A) and associated circuitry held within a housing 112A. The housing 112A, in turn, is optionally secured to a patient's wrist (not shown) or other extremity using a strap 120 or other securing means.

In one embodiment the microprocessor is the MSP430F2013 provided by Texas Instruments, Inc. of Plano, Tex. However, any suitable microprocessor may be used that allows a patient to activate and control cycles for somatosensory inputs.

The rehabilitation device 100A also includes a plurality of micro-motors 130. The micro-motors 130 are transducers that convert electrical energy into mechanical energy. In one aspect, the micro-motors 130 are so-called coin vibration motors, such as the C1020B00F81 motor of Jinlong Machinery & Electronics Co. of Wenzhou, Zhejiang, China and Brooklyn, N.Y. In the view of FIG. 1A, only a portion of one micro-motor 130 is visible, it being understood that the micro-motors 130 are embedded in the fingers of a glove 150A.

The rehabilitation device 100A further includes electrical wires 140. The wires 140 transmit electric current from a battery (shown at 170 in FIG. 3A) within the housing 112A to each of the micro-motors 130. Separate positive and negative wires extend from the housing 112A to each of the micro-motors 130. Electrical current is transmitted through the wires 140 according to signals sent by the microprocessor 111.

In the arrangement of FIG. 1A, the rehabilitation device 100A is a hand rehabilitation device. This means that the rehabilitation device 100A is configured to deliver somatosensory input to a patient's hand. In this instance, the strap 120 is configured and dimensioned to secure the housing 120 to a patient's wrist. This also means that the micro-motors 130 are placed along the patient's fingers.

To support the micro-motors 130 on the patient's fingers, a glove 150A is provided. In the illustrative arrangement of FIG. 1A, the glove 150A is a right-hand glove. It is understood that a second hand rehabilitation device 100A may be provided along with a left-hand glove (not shown). In either instance, the micro-motors 130 may be embedded within the glove 150A along either the dorsal side or the ventral side of the patient's fingers.

It is noted that the term "finger" as used herein includes the thumb. It is also noted that the glove 150A preferably leaves the finger tips exposed to enable mobility and to facilitate tactile sensation.

Figure 2A:
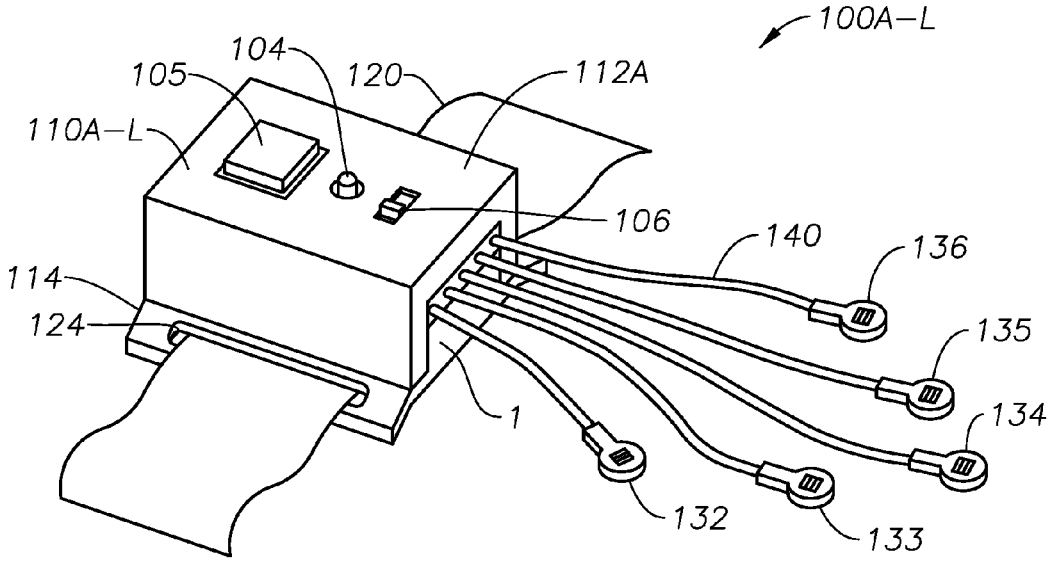
FIGS. 2A(L) and 2A(R) provide a pair of control units and associated wires of the rehabilitation device of FIG. 1A FIG. 2A(L) shows a unit that is used for a patient's left hand, while FIG. 2A(R) presents a unit that is used for a patient's right hand. In both units, wires are seen extending from the control units to respective micro-motors.
Figure 2A:
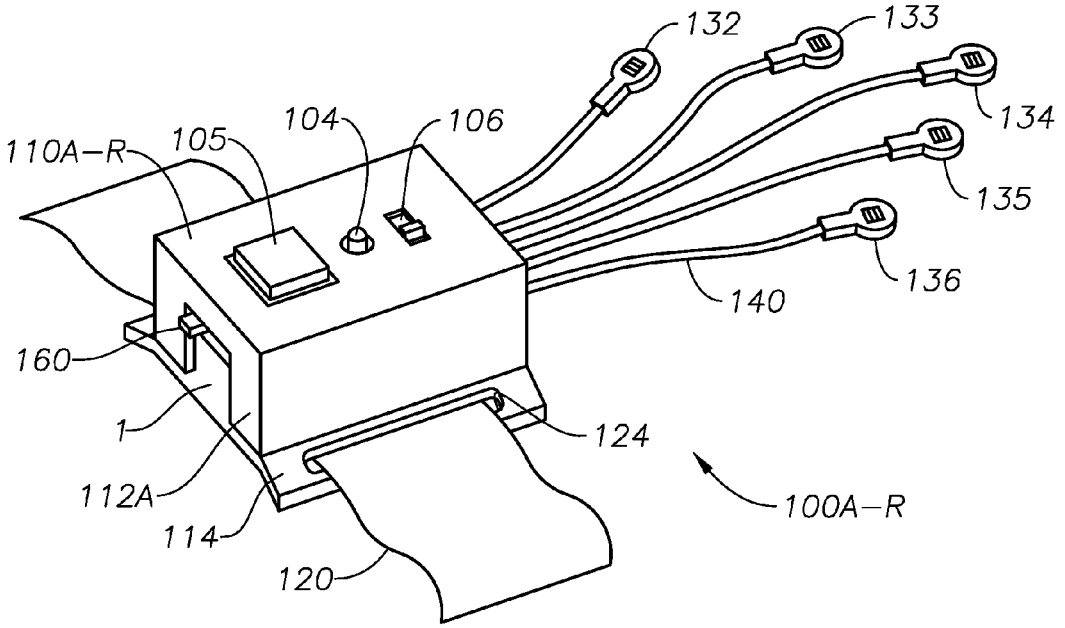

FIGS. 2A(L) and 2A(R) present perspective views of a pair of hand rehabilitation devices 100A-L and 100A-R (without gloves). FIG. 2A(L) shows a device 100A-L that is used for a patient's left hand, while FIG. 2A(R) presents a device 100A-R that is used for a patient's right hand. Each device 100A-L and 100A-R includes a control unit. One control unit, designated as 110A-L, includes wires 140 configured to deliver signals to micro-motors 130 on a patient's left hand; a second control unit, designated as 100A-R, includes wires 140 configured to deliver signals to micro-motors 130 on a patient's right hand. The micro-motors are individually designated as 132, 133, 134, 135 and 136. Micro-motors 132 are designed to reside within the glove 150A adjacent to a patient's thumb (not shown), while micro-motors 133, 134, 135 and 136 are dimensioned to reside within the glove 150A adjacent to the patient's four respective fingers (also not shown).

Control signals are provided from the control units 110A-L, 110A-R to the micro-motors 132, 133, 134, 135, 136 in pre-programmed sequences and for designated times. For example, a control signal may be sent to a first micro-motor, e.g., 132, to cause it to vibrate for 10 seconds. During this time, the patient will respond to the vibratory input by wiggling, rotating, flexing, or otherwise exercising the extremity point corresponding to that micro-motor 132. Thereafter, the signal is terminated. After a dead period of, for example, 4 seconds, a new control signal may be sent to a second micro-motor, e.g., 134, to cause it to vibrate for 10 seconds; then, that control signal will be terminated and a new dead period of, say, 5 seconds will follow. This cycle may be continued for each micro-motor 132, 133, 134, 135, 136 until control signals have been sent to each micro-motor for, say, three cycles.

Each control unit 110A-L, 110A-R includes a housing 112A. In the illustrative arrangement of FIGS. 2A(L) and 2A(R), the housing 112A has a generally rectangular profile. However, it is understood that the geometry of the housing 112A is not significant so long as it is small enough to be portable and, preferably, to be worn immediately on an extremity. The extremity may be a wrist or ankle. The housing 112A includes a base 114 having openings or slots 124. The slots 124 receive and support the strap 120.

The straps 120 in FIGS. 2A(L) and 2A(R) are ideally dimensioned to wrap around the patient's left and right wrists, respectively. The straps 120 will include any securing means (not shown) for securing the housings 112A to the patient's respective wrists. Such securing means may be buckles, clips, hook-and-loop materials, snaps, magnets, or other items well known for securing clothing, bandages or straps.

The straps 120 in FIG. 2A are ideally dimensioned to wrap around the patient's left and right wrists, respectively. The straps 120 will include any securing means (not shown) for securing the housings 112A to the patient's respective wrists. Such securing means may be buckles, clips, hook-and-loop materials, snaps, magnets, or other items well known for securing clothing, bandages or straps.

Each rehabilitation device 100A includes a light 104. The light 104 may be, for example, a red light-emitting diode (LED). The LED light 104 comes on whenever a control signal is being sent from the control unit 110A to a micro-motor 130. Illumination of the light 104 indicates the occurrence of vibration generated by one of the five micro-motors 132, 133, 134, 135, 136. The LED light 104 may be manually overridden (turned off) using a switch 106. This allows vibratory input only to guide patient tasks.

Each rehabilitation device 100A also includes a reset button 105. The reset button 105 allows the patient or a health care assistant to restart vibration and light cycles for the devices 100A.

Figure 3A:
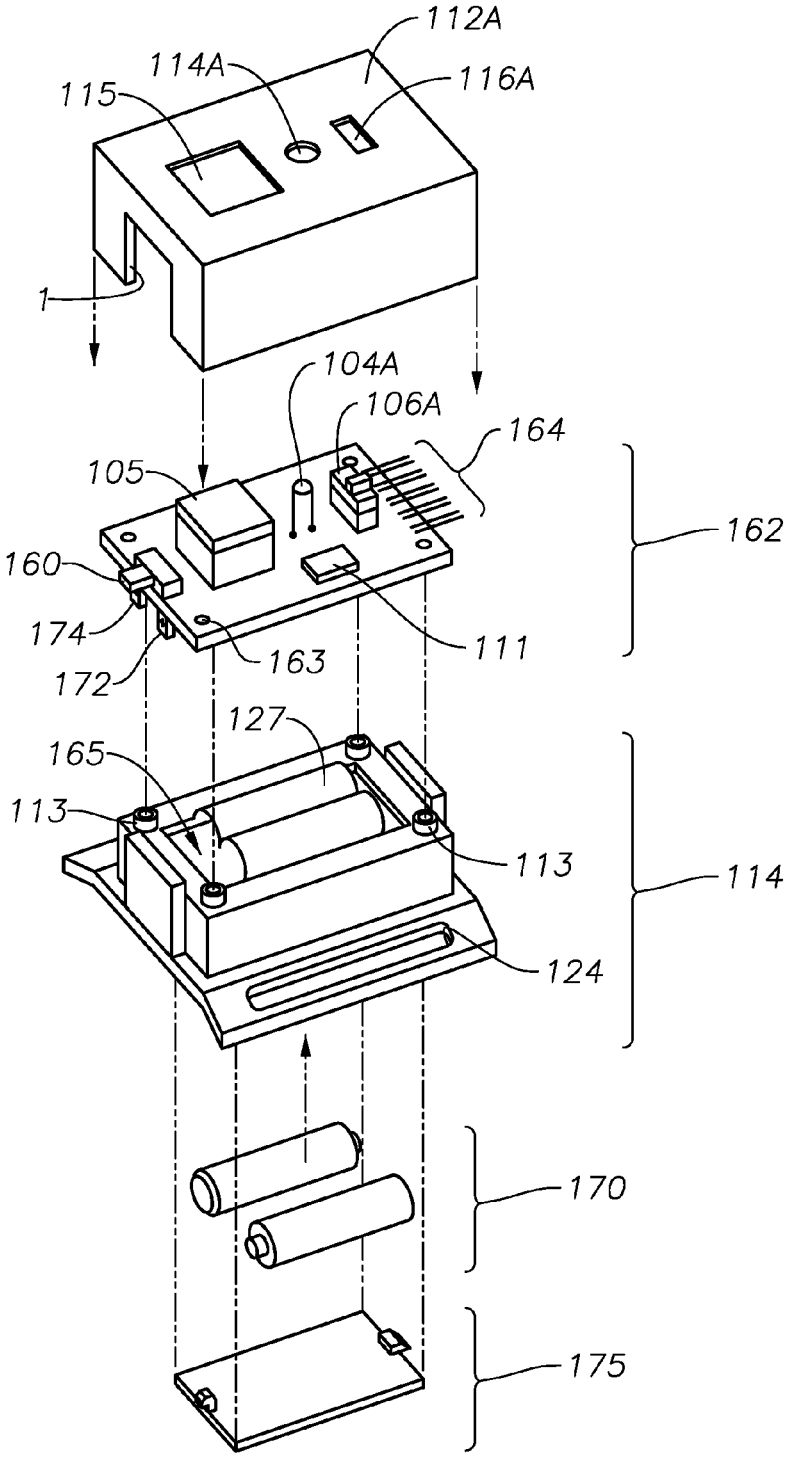
FIG. 3A offers an exploded view of the control unit of FIG. 2A. Selected components within the housing are seen, including a printed circuit board, a micro-controller, an LED and a pair of batteries.

FIG. 3A offers an exploded view of the control unit 110A of the devices 100A of FIG. 2A. Various components are seen, including the housing 112A, the reset button 105 and the light 104A.

FIG. 3A also shows a power switch 160. The power switch 160 allows the patient or a health care assistant to turn the rehabilitation device 100A off when the device 100A is not in operation. This, in turn, conserves battery power. The power switch 160 extends through an opening 1 in the housing 112A.

The device 100A runs on a power source. Preferably, the power source comprises one or more batteries, such as AA batteries 170. In this way, the device 100A is highly portable. However, the invention does not preclude the use of a power pack and power cord.

Various openings are provided in the housing 112A of the device 100A. Opening 115 accommodates the reset button 105; opening 114A accommodates the light 104A; and opening 116A accommodates the LED switch 106A.

A printed circuit board 162 resides within the housing 112A. The printed circuit board 162 provides electrical communication between various electrical components. Outputs 164 extend from the printed circuit board 162 to deliver control signals from the micro-processer 111 to the micro-motors 130.

The printed circuit board 162 is supported by the base 114. Openings 163 are provided along corners of the printed circuit board 162 for landing on corresponding sockets 113 in the base 114 and for receiving attachment screws (not shown). The base 114 includes the slots 124 for receiving the strap 120 of FIG. 1A. The base 114 also includes a battery case 127 for receiving AA batteries 170. Finally, the base 114 offers an opening 165 through which electrical leads 172, 174 pass. The electrical leads 172, 174 provide electrical communication between the batteries 170 and the printed circuit board 162.

It is noted that in the arrangement of FIG. 3A, the batteries 170 reside under the base 114. A battery case cover 175 is provided to secure the batteries 170 in place under the base 114. For purposes of this disclosure, such an arrangement is considered storing the batteries 170 within the housing 112A.

FIG. 4 provides perspective views of a micro-motor 430, in one aspect. Four separate drawings are designated as "A," "B," "C," and "D."

The drawings designated as "A" and "B" represent top 432 and bottom 434 portions of a micro-motor housing, respectively. The top 432 and bottom 434 portions are designed to mate together in order to form a shell for holding a vibratory device 436.

The drawing designated as "C" shows the bottom portion 434 of the housing. Here, a vibratory device 436 has been placed therein. Wires 438 extend from the vibratory device 436 and out of the bottom portion 434 of the housing. In operation, the wires 438 will connect to the circuitry of the printed circuit board 162.

The drawing designated as "D" shows the top 432 and bottom 434 portions of the housing connected together. This represents the complete micro-motor 430. The micro-motor 430 may be, for example, a so-called coin motor or pancake motor having a diameter of 8 to 16 mm and a thickness of 3 to 8 mm. The micro-motor 130 may have a rated voltage of about 1.5 to 5.0 volts, and an operational speed of about 5,000 to 20,000 rpm or, more preferably, 7,500 to 11,000 rpm.

The micro-motor 436 is intended to be in electrical communication with a controller, such as micro-processer 111. As noted, a micro-processer 111 resides within the housing 112A of the control unit 110A. The micro-processer 111 is arranged to transmit signals to the micro-motors (shown in FIG. 2A as micro-motors 132, 133, 134, 135 and 136) and the light 104A in cycles. For example, a first vibratory signal may be sent to a first micro-motor 132, and a first light signal may be simultaneously sent to the light 104A. This causes the first micro-motor 132 and the light 104A to illuminate simultaneously. The light 104A will stay illuminated for as long as the first micro-motor 132 is vibrating, providing the patient with somatosensory input.

During this time, the patient will move the finger that is receiving vibrations from the first micro-motor 132. Motion will continue for as long as the micro-motor 132 is vibrating and the light 104A is illuminated. After a designated period of time, such as 5 seconds or 10 seconds, the signals will be discontinued, causing the first micro-motor 132 to no longer vibrate and causing the light 104A to no longer illuminate. Thereafter, a short dead period will be introduced where no vibrations and no illumination take place. The patient will rest during the dead period, and await a next signal.

After the dead period, a next set of signals will be sent by the micro-processer 111. For example, a second vibratory signal may be sent to micro-motor 136, with a corresponding light signal being sent to the light 104A. This new set of signals may take place for a period of, for example, three to eight seconds, during which time the patient will move or exercise the finger associated with micro-motor 136. Thereafter, a second dead period will be introduced. Each dead period may be, for example, from 2 to 10 seconds or, more preferably, about 4 seconds.

It is noted that the light switch 106A allows the patient or health care attendant to override the illumination of the light 104A during vibration cycles. This introduces a level of difficulty to the patient during rehabilitation. The patient must then rely solely upon tactile sensation to know when to begin exercising an extremity part. To introduce further complexity, the micro-processer 111 may be programmed such that vibratory periods are random as between the micro-motors 132, 133, 134, 135, 136. Furthermore, the times for vibratory periods may be different, such that a first signal is, for example, 6 seconds; a second signal is 8 seconds; a third signal is 2 seconds; a fourth signal is 10 seconds; and a fifth signal is 5 seconds. Dead periods between these signals may also be varied, such as between 2 and 8 seconds. In this way, the patient is challenged to concentrate on the tactile and, optionally, visual stimulation for exercise.

The micro-processer 111 is pre-programmed to conduct a number of therapy cycles. In one aspect, the patient or physical therapist communicates with the micro-processer 111 through a so-called smart phone or a tablet, such as the iPhone® or the iPad® offered by Apple, Inc. of Cupertino, Calif. The communication may be through Bluetooth or other wireless communication system using an application on the smart phone or tablet. The application, or "App," allows the patient or his or her therapist to select a cycle and a level of difficulty.

In one aspect, the degree of current to a particular micro-motor 130 may be varied. As the patient improves, the degree of current may be reduced, causing vibratory input to be more subtle. This further increases the level of difficulty.

The portable rehabilitation device 100A of FIG. 1A presents one embodiment for a rehabilitation device. In this embodiment, five micro-motors 130 are provided, with each micro-motor 130 arranged to provide vibratory stimulation to a selected finger. However, additional micro-motors 130 may be provided to increase stimulation.

Figure 1B:
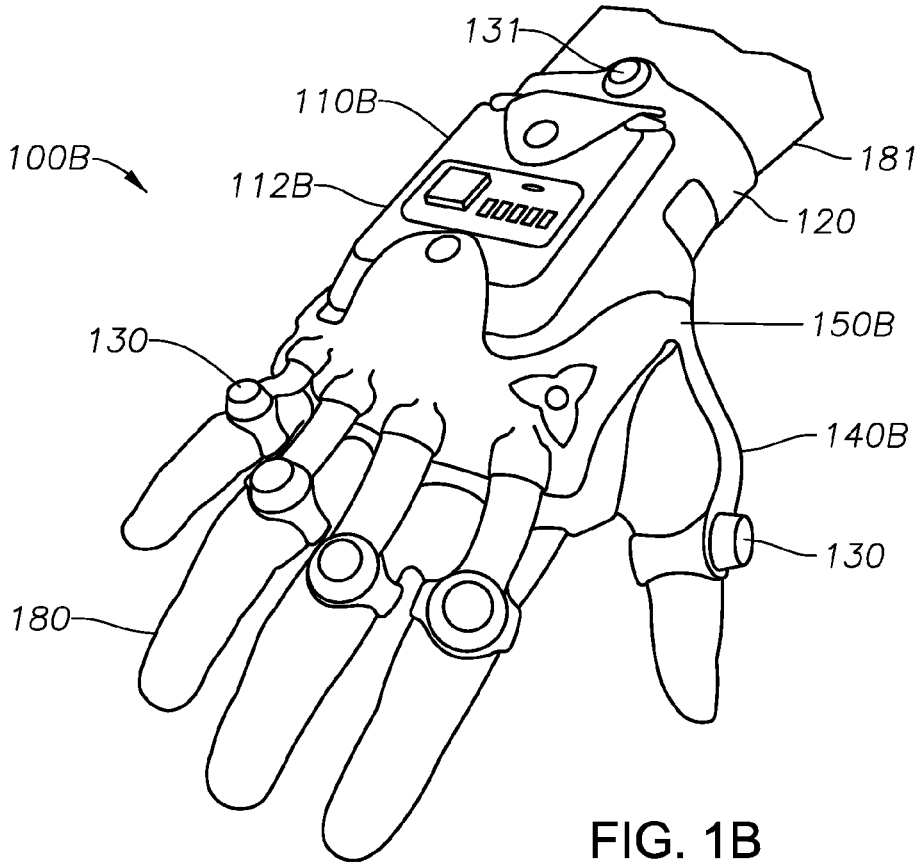
FIG. 1B is a perspective view of a portable hand rehabilitation device according to the present invention, in an alternate embodiment. An illustrative control unit and glove are again shown.

FIG. 1B is a perspective view of a portable rehabilitation device 100B according to the present invention, in an alternate embodiment. The device 100B shown in FIG. 1B represents a more advanced embodiment. Here, two micro-motors 130 are placed along each finger 180, preferably on the dorsal side and on the ventral side of each finger 180. In addition, two micro-motors 131 are placed along a wrist 181, with one micro-motor 131 being on the dorsal side and the other being on the ventral side of the wrist 181. In this way stimuli may be delivered not only to the fingers 180, but also to the wrist 181. Stimuli are delivered on each side of the fingers and wrist to increase somatosensory input.

As with the device 100A, the portable rehabilitation device 100B shown in FIG. 1B includes a control unit 110B. The control unit 110B defines a micro-processor (seen at 111 in FIG. 3B) and associated circuitry held within a housing 112B. The housing 112B, in turn, is secured to the patient's wrist 181 (or, alternatively, ankle) using a brace 120B or other securing means.

In one embodiment the microprocessor is the MSP430-F2013 provided by Texas Instruments, Inc. of Plano, Tex. This is an ultra-low power controller that features a 16-bit RISC CPU, 16-bit registers, and constant generators that contribute to code efficiency. A digitally controlled oscillator (DCO) allows wake-up from low-power modes to active mode in less than 1 μs. However, any suitable micro-processor may be used that allows a patient to activate and control cycles for somatosensory input.

As noted, the rehabilitation device 100B also includes a plurality of micro-motors 130. The micro-motors 130 may be designed in accordance with the micro-motors 130/430 described above in connection with FIGS. 2A and 4. In this respect, the micro-motors 130 are transducers that convert electrical energy into mechanical energy. Cycles of mechanical energy are generated by the micro-motors 130, forming vibrations.

Figure 2B:
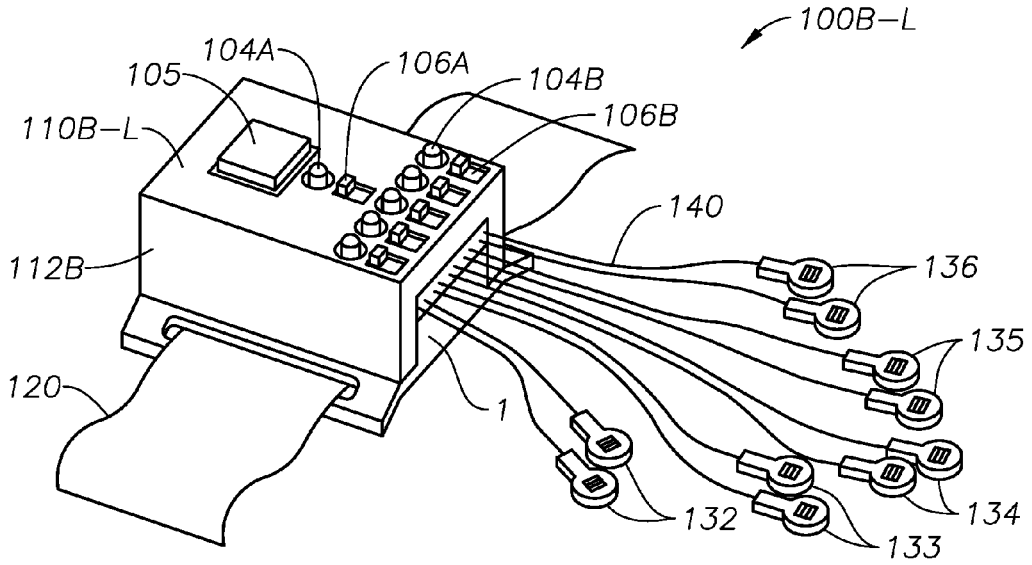
FIGS. 2B(L) and 2B(R) provide a pair of control units and associated wires of the rehabilitation device of FIG. 1B.
Figure 2B:
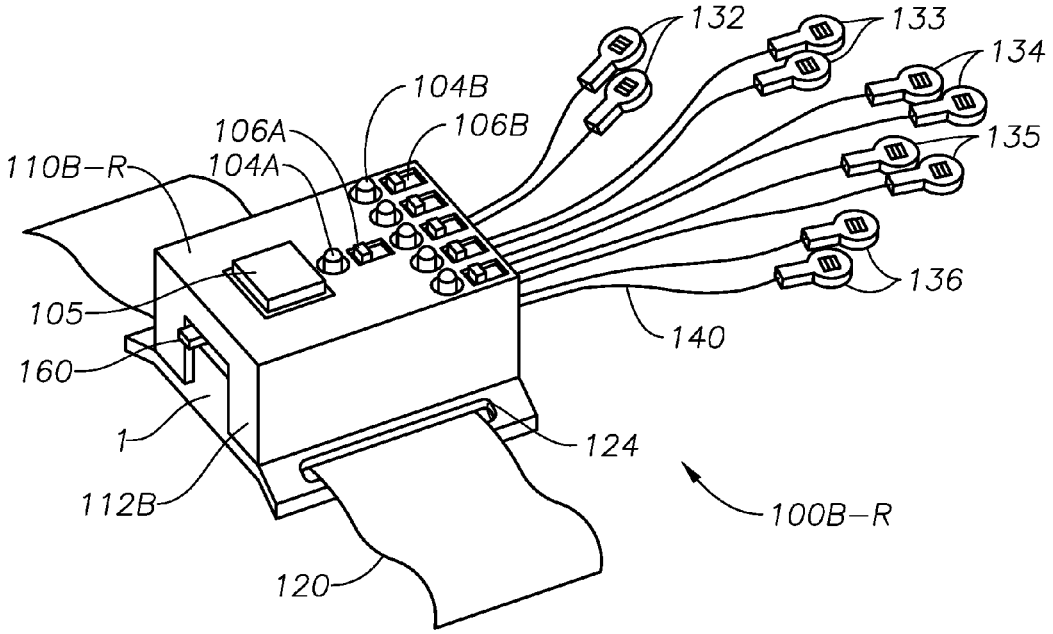

The rehabilitation device 100B further includes electrical wires (seen at 140 in FIGS. 2B(L) and 2B(R)). The wires 140 transmit electric current from batteries (shown at 170 in FIG. 3B) within the housing 112B to each of the micro-motors 130. In the arrangement of FIG. 1B, the wires 140 are encased within insulated channels of a glove 150B. Electrical current is transmitted through the channels according to signals sent by the micro-processor 111.

It is noted here that the glove 150B of FIG. 1B covers only a portion of the hand and fingers. In this instance, the glove 150B is really more of a skeleton. The skeleton design increases comfort to the patient and is easier to don and doff. For purposes of the present disclosure, the term "glove" includes any support structure for carrying a hand rehabilitation device 100B. Preferably, the support structure includes an elastic material that is sewn into a middle posterior portion of the glove 150B. This allows more of a "one size fits all" or "two sizes fits all" approach.

FIGS. 2B(L) and 2(B)(R) a present perspective view of a pair of hand rehabilitation devices 100B-L and 100B-R. FIG. 2B(L) shows a device 100B-L that is used for a patient's left hand, while FIG. 2B(R) presents a device 100B-R that is used for a patient's right hand. Each device 100B-L and 100B-R includes a micro-processor (seen at 111 in FIG. 3B). The micro-processors 111 reside within and are part of a control unit. One control unit, designated as 110B-L, includes wires 140 configured to deliver vibratory signals to micro-motors 130 on a patient's left hand; a second control unit, designated as 110B-R, includes wires 140 configured to deliver vibratory signals to micro-motors 130 on a patient's right hand. The micro-motors are individually designated as 132, 133, 134, 135 and 136. Micro-motors 132 are designed to reside along the glove 150B adjacent to a patient's thumb (not shown in FIG. 2B), while micro-motors 133, 134, 135 and 136 are dimensioned to reside within the glove 150B adjacent to the patient's fingers (also not shown).

It is noted in the arrangement of FIGS. 2B(L) and 2B(R) that the micro-motors 132, 133, 134, 135, 136 are arranged in pairs. As discussed above, the micro-motors are arranged in pairs so that mechanical stimuli may be beneficially delivered to a patient's fingers on opposing sides of each respective finger.

Signals are provided from the micro-processors 111 in the control units 110B-L, 110B-R to the micro-motors 132, 133, 134, 135, 136 in pre-programmed sequences and for designated times. For example, a control signal may be sent to a first micro-motor pair, e.g., 132, to cause the pair to vibrate for 10 seconds. During this time, the patient will wiggle, rotate, flex, or otherwise exercise the finger associated with the micro-motor pair. Thereafter; the signal is terminated. After a dead period of, for example, 4 seconds, a new control signal may be sent to a second micro-motor pair, e.g., 135, to cause the micro-motors to vibrate for 10 seconds; then, that control signal will be terminated and a new dead period of, for example, 6 seconds will follow. This cycle may be continued for each micro-motor pair 132, 133, 134, 135, 136 until control signals have been sent to each micro-motor pair for, say, five cycles.

As noted, each micro-processor, or controller 111, resides within a housing 112B. In the illustrative arrangement of FIGS. 2B(L) and 2B(R), the housing 112B has a generally rectangular profile. However, it is understood that the geometry of the housing 112B is not significant so long as it is small enough to be portable and, preferably, to be worn immediately on an extremity. The extremity may be a wrist or ankle. The housing 112B includes a base 114 and may have openings or slots 124 that receive a strap 120. More preferably, the housing 112B is embedded into the brace 120 for the device 100B as shown in the embodiment of FIG. 1B.

The rehabilitation devices 100B-L and 100B-R include the light 104A and the override switch 106A as described above in connection with FIG. 2A. However, the rehabilitation devices 100B-L, 100B-R also include a bank of lights 104B. The individual lights in the bank of lights 104B may also be, for example, red light-emitting diodes (LED's). Each LED light 104B corresponds to a micro-motor pair 130. In addition, an override switch 106B is provided for each light in the bank of lights 104B.

In the rehabilitation device 100B, the patient is presented with a choice of using no lights, using one light 104A, or using the bank of lights 104B. When using the bank of lights 104B, the patient has the choice of overriding one, two, three or four of the lights 104B using switches in a bank of override switches 104B.

Where the patient chooses to use only the single light 104A in a rehabilitation device 110B, the patient will turn the switches in the bank of override switches 106B to an "off" position. This overrides the lights in the bank of lights 104B to keep them from being illuminated when control signals are sent to a micro-motor 130. The rehabilitation devices 100B-L, 100B-R then operate in the same manner as described above for the rehabilitation devices 100A-L, 100A-R. Somatosensory input will include illumination of single lights 104A in the rehabilitation devices 110B when any micro-motor 130 is vibrating.

Where the patient chooses to use the lights in the bank of lights 104B, the patient will turn the single switch 106A in each rehabilitation device 100B-L, 100B-R to an "off" position. This overrides the single lights 104A and keeps them from illuminating when control signals are being sent to the pairs of micro-motors 130. The rehabilitation devices 100B-L and 100B-R then offer visual input for the patient in the form of either sequenced or random illumination of selected lights in the bank of lights 104B.

In operation, an LED light in the bank of lights 104B is illuminated when a control signal is sent from the micro-processor 111 to a selected pair of micro-motors 130. Stated another way, illumination of a light 104B indicates the occurrence of vibration generated by one of the five micro-motor pairs 132, 133, 134, 135, 136. Of interest, the illuminated light corresponds in position in the housing 112B to a micro-motor pair 130.

It is again noted that selected lights in the bank of lights 104B may be turned off by turning a corresponding override switch in the bank of switches 106B to an "off" position. This allows only vibratory input, increasing the level of challenge to the patient in his or her rehabilitation process.

Each rehabilitation device 100B also includes a reset button 105. The reset button 105 allows the patient or a health care assistant to restart vibration and light cycles for the devices 100B.

Figure 3B:
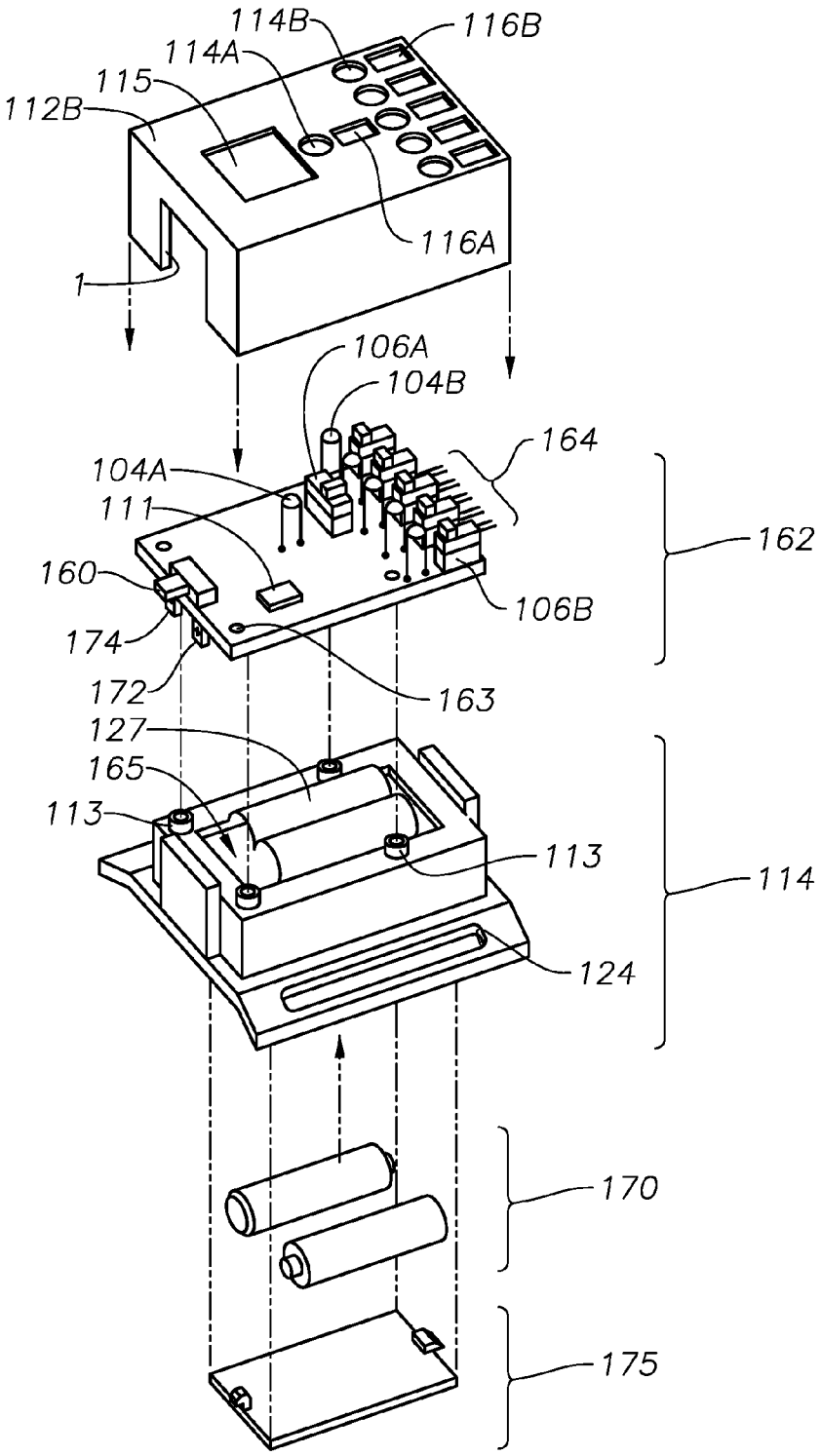
FIG. 3B offers an exploded view of the control unit of FIG. 2B. Selected components within the housing are seen, including a printed circuit board, a micro-controller, a plurality of LED lights and a pair of batteries.
Figure 4B:
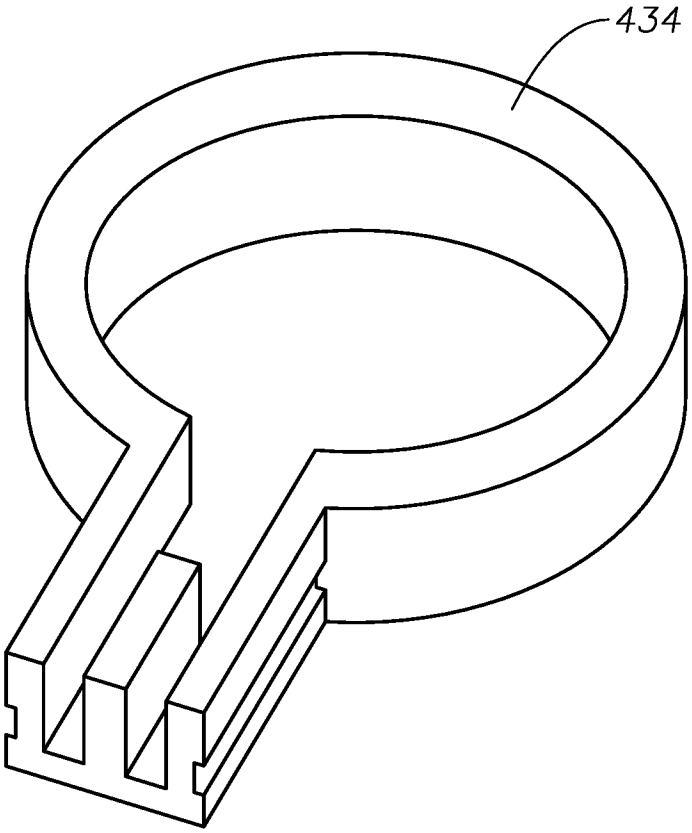
FIG. 4 provides perspective views of a micro-motor, in one aspect. Four separate drawings are designated as "A," "B," "C," and "D."
Figure 4A:
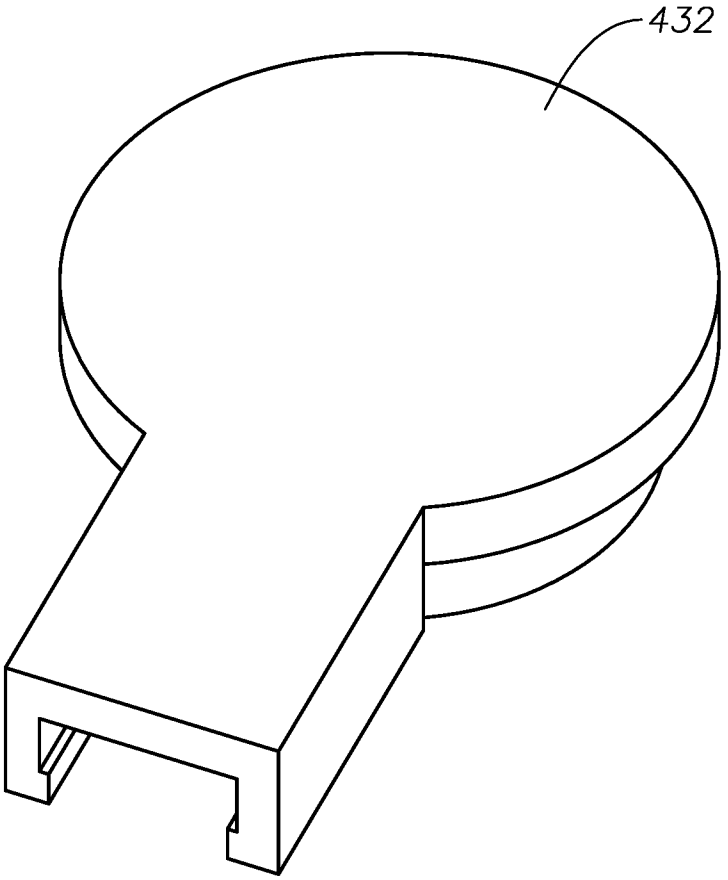
Figure 4D:
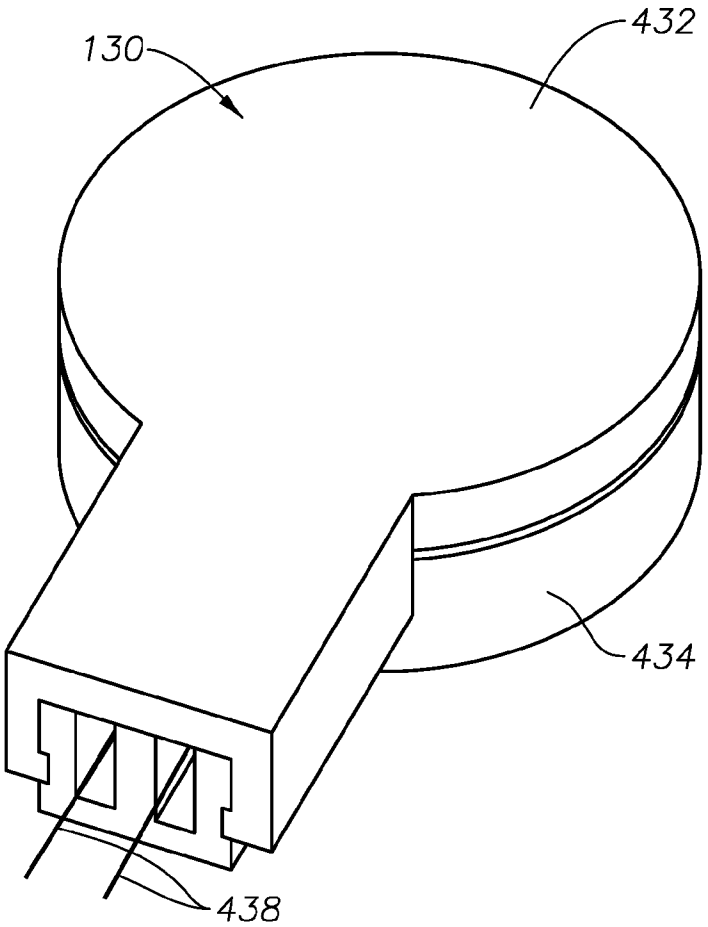
Figure 4C:
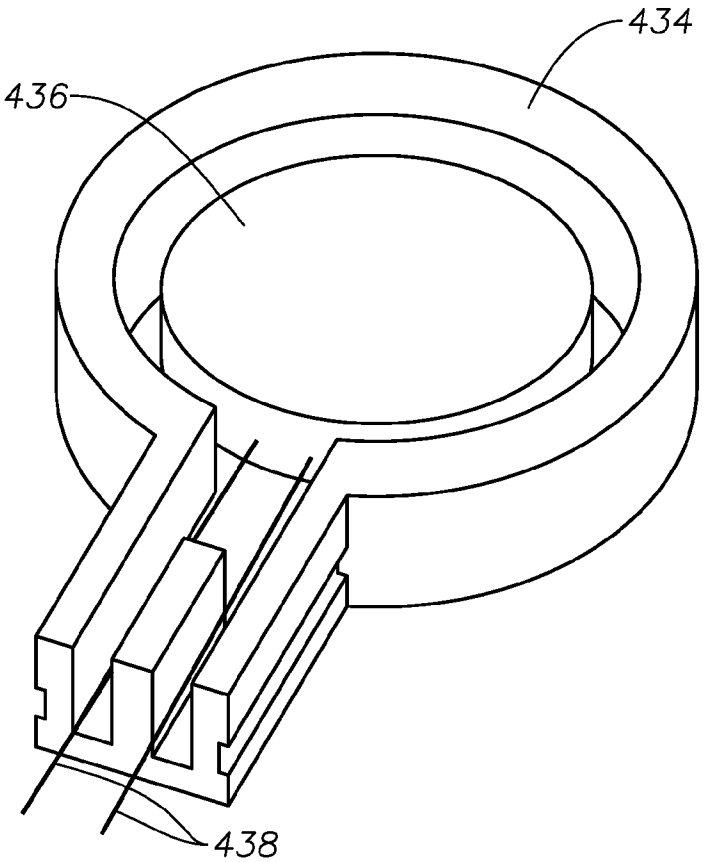

FIG. 3B offers an exploded view of a control unit 110B of the devices 100B-L and 100B-R of FIGS. 2B(L) and 2B(R). Various components are seen, including the micro-processor 111, the reset button 105 and the lights 106A, 106B. Additional features include the power switch 160 and the batteries 170. Still additional features include opening 115 for the reset button 105; opening 114A for the single light 104A; and opening 116A for the single LED switch 106A. Additional openings include openings 114B for the bank of lights 104B and openings 116B for the bank of override switches 106B.

Additional features of the control unit 110B are generally in accordance with the control unit 110A, except for offering the bank of lights 104B and the bank of override switches 106B, and except for the use of micro-motor pairs 132, 133, 134, 135, 136. Accordingly, additional details concerning the control unit 110B need not be repeated. However, it is noted that dorsal and ventral micro-motors may optionally be separately programmed during for exercise.

The rehabilitation devices 100A, 100B operate to improve motor function in a patient by providing vibratory stimulation in the fingers along with visual prompting. Medical research in the neurosciences field suggests that physical stimulation improves somatosensory input, which in turn enhances motor recovery in stroke patients. Further, using vibration as a trigger (go cue), the devices facilitate brain engagement, which is believed to be more efficient in promoting motor recovery than using somatosensory input as passive stimulation only.

Studies have suggested that somatosensory-related activation levels in SI are modulated by the context within which tactile stimuli are delivered. Vibro-tactile stimuli may be active or may be passive. Vibro-tactile stimuli presented during active frequency discrimination are associated with enhanced SI activity when compared to that elicited by passive vibro-tactile input. Active use of the combination of tactile and visual stimuli enhances attentional control over perceptual selection. It is believed that activity of SI neurons differs, depending on functional significance of somatosensory inputs.

It has been observed by the applicants herein that hand/wrist movements that are guided by somatosensory inputs initiate faster and reach target with greater success rates when compared with movements guided by visual input alone. Therefore, the present invention employs somatosensory inputs as active guidance of motor tasks in the form of a portable device. In contrast to expensive robot-aided therapy that is usually offered in rehabilitation centers, the devices herein offer a portable, cost-efficient instrument for long-term home-based rehabilitation.

During hand rehabilitation, the housing will be attached to the patient's wrist. The micro-motors will be positioned along individual fingers, wrists and/or palmar pads. The controller is programmed to provide a timing and sequence of vibrations among the micro-motors that enables improved motor function. The controller may be re-programmed as needed to offer increased challenge to the patient during recovery. In one aspect, current is reduced to decrease the level of vibratory stimulation, thereby increasing the challenge to the patient during rehabilitation.

The vibro-somatosensory inputs delivered by the micro-motors can be used as the go-cue and/or stop signal, depending on the design of the rehabilitation task. The vibratory inputs can also serve as a somatosensory feedback when coupled with hand movements for stroke victims.

The therapeutic device described herein provides an active functional task-guidance during rehabilitation to mobilize a larger number of neural elements. Such neural elements may include both central and peripheral structures to facilitate hand function. The device emphasizes patients' attention during rehabilitation, which is important in effective functional recovery of a deficit hand. The device may be applied to the lower extremity of the patient as well. In this instance, the glove may be modified to serve as a sock, as shown in FIG. 6 at 600.

FIG. 6 is a perspective view of a portable rehabilitation device 600 according to a second embodiment. Here, the device 600 is configured to provide neuro-electrical stimulation of a patient's lower extremity. The device 600 includes a sock 610, and control unit 110A. As with rehabilitation device 100A, the control unit 110A of rehabilitation device 600 defines a micro-processor (seen at 111 in FIG. 3A) and associated circuitry held within a housing 112A. The housing 112A, in turn, is optionally secured to a patient's ankle (not shown) or other extremity using a strap 120 or other securing means. The rehabilitation device 600 also includes a plurality of micro-motors 130 designed to stimulate a patient's toes.

In one aspect, the housing includes a USB connection that allows data gathered concerning use of the device to be uploaded to a computer as a digital file. Uploading may take place, for example, at a doctor's office or a rehabilitation center. Alternatively, uploading may be done on a patient's computer or hand-held device, and then sent via electronic mail to a health care provider. This confirms that the rehabilitation device is actually being used by the patient and helps the provider, the carrier, or CMS establish benchmarks. In one aspect, the USB connection also allows the micro-processor to be re-programmed to create different sequences of vibratory and/or light sequences.

FIG. 5 is a flow chart showing steps for performing a method 500 for providing neuro-electrical stimulation of a patient's upper extremities, in one embodiment. The method 500 uses somatosensory input as a functional guidance to improve motor function.

In one embodiment, the method 500 first includes attaching a therapeutic device to a patient's extremity. This is seen in Box 510. The extremity is preferably the patient's wrist, but may alternatively be an ankle. The therapeutic device is arranged such that at least one micro-motor is placed along a corresponding patient digit (or extremity point). Where the therapeutic device is attached to the patient's wrist, the micro-motors will be placed along the fingers (including the thumb).

In one aspect, the micro-motors are positioned in pairs. This means that micro-motors are placed on opposing sides of a patient's respective fingers. This increases the tactile stimuli to the patient.

The method 500 next includes activating the therapeutic device. This is provided in Box 520. Activating the therapeutic device generates a sequence of control signals that are sent to the various micro-motors. The micro-motors, in turn, vibrate to deliver vibratory somatosensory inputs to the patient. Activating the therapeutic device may be done by pressing a reset button.

The control signals are sent by a micro-processor as discussed above. Times for delivering control signals may be adjusted, and times for dead periods between control signals may vary.

The method 500 further includes the optional step of turning a switch to an "on" position. This is indicated at Box 530. When the switch is in the "on" position, a light is illuminated during the time that a micro-motor is vibrating. In this way, the patient also receives visual as well as somatosensory inputs.

The method 500 also comprises monitoring patient movement of digits in response to the vibratory and optional visual inputs. This is seen at Box 540. Monitoring may mean assistance and encouragement offered by a physical therapist or attendant. Alternatively or in addition, monitoring may mean evaluation by the patient himself or herself. Alternatively or in addition, monitoring may mean recording therapy cycles in memory associated with the therapeutic device, and transmitting those to a health care provider or an insurance entity.

The method 500 also includes resetting the therapeutic device. This is shown at Box 550. Resetting the therapeutic device initiates a new cycle of vibratory and, optionally, visual inputs. The new cycle of vibratory inputs provides a different sequence of control signals, a different duration of control signals, or both. Resetting may also be done by pressing a reset button.

Optionally, the method 500 includes selecting lights from a bank of lights on the therapeutic device. This is given at Box 560. The selected lights will illuminate when a corresponding micro-motor is vibrating.

While it will be apparent that the inventions herein described are well calculated to achieve the benefits and advantages set forth above, it will be appreciated that the inventions are susceptible to modification, variation and change without departing from the spirit thereof.

I claim:

1. A portable therapeutic device for improving voluntary control of paretic muscles in a patient extremity, comprising:

a plurality of micro-motors configured to deliver a vibratory sensation to selected patient extremity points as vibratory inputs;

a housing;

a plurality of light sources arranged on the housing to deliver visual input to the patient when a micro-motor is vibrating, wherein each light source is associated with a designated micro-motor;

a micro-processor residing within the housing and programmed to send control signals to actuate the micro-motors and associated light sources for designated times and sequences in order to form cycles of somatosensory inputs;

a manual override switch for selectively preventing the plurality of light sources from commencing illumination during any portion of the cycles of somatosensory inputs; and a reset button configured to initiate a new cycle of vibratory and visual inputs by the micro-processor in response to manual resetting.

2. The therapeutic device of claim 1, further comprising:

one or more batteries residing within the housing for providing power; and a power switch for manually activating and de-activating power to the micro-processor.

3. The therapeutic device of claim 1, wherein:

the extremity points are fingers such that each of the plurality of micro-motors is dimensioned to reside along a patient's finger; and the device further comprises a glove for supporting each of the micro-motors adjacent to the patient's respective fingers.

4. The therapeutic device of claim 1, wherein:

the extremity points are toes such that each of the plurality of micro-motors is dimensioned to reside along a patient's foot; and the device further comprises a sock for supporting each of the micro-motors along the patient's foot.

5. The therapeutic device of claim 1, wherein the micro-processor communicates with each of the micro-motors through either a wired or a wireless signal.

6. The therapeutic device of claim 1, wherein:

the cycles of somatosensory inputs comprise at least a first cycle and a second cycle; and the second cycle of vibratory inputs provides a different sequence of control signals, a different duration of control signals, or both, relative to the first cycle.

7. The therapeutic device of claim 1, wherein:

the extremity points are fingers such that each of the plurality of micro-motors is dimensioned to reside on a patient's finger;

the plurality of micro-motors comprises pairs of micro-motors such that a micro-motor resides on each of two opposing sides of each of the patient's fingers so that each finger receives a pair of micro-motors;

the device further comprises a pair of micro-motors configured to be placed on the patient's wrist, with a first micro-motor of the pair of micro-motors being proximate the dorsal side of the patient's wrist, and a second micro-motor of the pair of micro-motors being proximate the ventral side of the patient's wrist;

each light source of the plurality of light sources is associated with a designated pair of micro-motors; and the cycles of somatosensory inputs comprise cycles of vibratory and light inputs corresponding to the patient's fingers and wrist.

8. The therapeutic device of claim 1, wherein the manual override switch is configured to selectively prevent each light source of the plurality of light sources from commencing illumination during any portion of the cycles of somatosensory inputs.

9. A portable therapeutic device for improving voluntary control of paretic muscles in a patient's upper extremity, comprising:

a plurality of micro-motors configured to deliver a vibratory sensation to the patient's fingers as vibratory inputs, wherein the micro-motors are arranged in pairs placed along opposing sides of each finger such that the opposing sides of each finger receive a micro-motor;

a housing dimensioned to reside proximate a wrist of the upper extremity;

a light source arranged on the housing to deliver visual input to the patient when a micro-motor is vibrating;

a micro-processor residing within the housing and programmed to send control signals to actuate the micro-motors and light source for designated times and sequences in order to form cycles of somatosensory inputs;

a manual override switch for selectively preventing the light source from commencing illumination during any portion of the cycles of somatosensory inputs; and a reset button for initiating a new cycle of somatosensory inputs in response to manual resetting.

10. The therapeutic device of claim 9, further comprising:

one or more batteries residing within the housing for providing power; and a power switch for manually activating and de-activating power to the micro-processor.

11. The therapeutic device of claim 10, wherein:

the housing containing the light source, the micro-processor and the one or more batteries defines a control unit; and the control unit is dimensioned to reside along the patient's wrist.

12. The therapeutic device of claim 11, further comprising:

a glove for supporting each of the micro-motors adjacent to the patient's respective fingers.

13. The therapeutic device of claim 12, wherein the control unit is embedded into the glove proximate the patient's wrist.

14. The therapeutic device of claim 11, wherein the micro-processor communicates with each of the micro-motors through an insulated wire.

15. The therapeutic device of claim 11, wherein:

the cycles of somatosensory inputs comprise at least a first cycle and a second cycle; and the second cycle of vibratory inputs provides a different sequence of control signals, a different duration of control signals, or both relative to the first cycle.

16. The therapeutic device of claim 11, further comprising:

a pair of micro-motors configured to be placed on the patient's wrist, with a first micro-motor of the pair of micro-motors being proximate the dorsal side of the patient's, wrist, and a second micro-motor of the pair of micro-motors being proximate the ventral side of the patient's wrist; and the cycles of somatosensory inputs comprise cycles of vibratory inputs delivered to the patient's fingers and wrist.

17. The therapeutic device of claim 11, wherein the light source comprises a bank of lights corresponding to the pairs of micro-motors such that a light is illuminated when a control signal is sent to vibrate a corresponding pair of micro-motors.

18. The therapeutic device of claim 17, further comprising:

a bank of override switches having switches that correspond to the lights in the bank of lights and to the pairs of micro-motors for selectively preventing a light from illuminating during cycles of somatosensory inputs.

19. The therapeutic device of claim 17, further comprising:

a memory for storing patient use events.

20. A method of using somatosensory input as a functional guidance to improve motor function in a patient extremity, comprising the steps of:

securing a therapeutic device along the patient's upper extremity, the therapeutic device comprising:

a plurality of micro-motors configured to deliver a vibratory sensation to patient extremity points as vibratory inputs, with each micro-motor being dimensioned to reside on a patient's respective finger, a housing, a light source arranged on the housing to deliver visual input to the patient when a micro-motor is vibrating, a manual override switch for selectively preventing the light source from commencing illumination during any portion of a somatosensory input cycle, and a micro-processor residing within the housing and programmed to send control signals to actuate the micro-motors and light source for designated times and sequences in order to form cycles of somatosensory inputs;

initiating a first cycle of vibratory inputs from the micro-motors according to the programming of the micro-processor;

selecting an operation mode of the manual override switch to turn "on" or "off" the light source during a somatosensory input cycle;

pressing a reset button on the housing in order to initiate a second and different cycle of vibratory inputs after completing the first cycle; and monitoring patient movement of the extremity points in response to the vibratory inputs of the respective micro-motors.

21. The method of claim 20, further comprising the steps of:

placing a manual override switch along the housing in an "on" position so that the light source illuminates when a micro-motor is vibrating; and receiving visual feedback from the light source during the first cycle;

and wherein the therapeutic device further comprises:

one or more batteries residing within the housing for providing power, and a power switch for manually activating and de-activating power to the micro-processor.

22. The method of claim 21, wherein:

the housing containing the light source, the micro-processor and the batteries defines a control unit; and the control unit is dimensioned to reside along the patient's wrist.

23. The method of claim 22, wherein the therapeutic device further comprises:

a glove for supporting each of the micro-motors adjacent to the patient's respective fingers.

24. The method of claim 22, wherein:

the cycles of somatosensory inputs comprise at least a first cycle and a second cycle; and the second cycle of vibratory inputs provides a different sequence of control signals, a different duration of control signals, or both, relative to the first cycle.

25. The method of claim 22, wherein:

the plurality of micro-motors comprises pairs of micro-motors such that a first pair of micro-motors resides on opposing sides of each of the patient's fingers such that each front and each back surface of each finger receives a micro-motor;

the device further comprises a pair of micro-motors configured to be placed on the dorsal and ventral sides of the patient's wrist, respectively, with a first micro-motor of the pair of micro-motors being configured to be placed proximate the dorsal said of the patient's wrist, and a second micro-motor of the pair of micro-motors being configured to be placed proximate the ventral side of the patient's wrist; and the cycles of somatosensory inputs comprise cycles of vibratory inputs delivered to the patient's fingers and wrist.

26. The method of claim 22, wherein:

the therapeutic device further comprises a bank of lights wherein each light of the bank of lights corresponds to a pair of micro-motors of the pairs of micro-motors such that a light is illuminated when a control signal is sent to vibrate a corresponding pair of micro-motors, and a bank of manual override switches wherein each manual override switch of the bank of manual override switches correspond to a light in the bank of lights and to one pair of micro-motors for selectively preventing a pair of lights from illuminating during cycles of somatosensory inputs; and the method further comprises placing at least one of the override switches along the bank of switches in an "on" position so that the light sources corresponding to the at least one manual override switch are placed in an "on" position illuminates when corresponding micro-motors are vibrating; and receiving visual feedback from the light sources corresponding to the control signal sent to vibrate a corresponding pair of micro-motors during the first cycle.

27. A portable therapeutic device for improving voluntary control of paretic muscles in a patient's upper extremity, comprising:

a plurality of micro-motors configured to deliver a vibratory sensation to the patient's fingers as vibratory inputs, wherein the micro-motors are arranged in pairs placed along opposing sides of each finger such that opposing surfaces of each finger receives a micro-motor;

a glove dimensioned to fit onto the patient's hand and supporting each of the micro-motors adjacent to the patient's respective fingers;

a light source placed along the glove to deliver visual input to the patient when a micro-motor is vibrating;

a micro-processor embedded in the glove and programmed to send control signals to actuate the micro-motors and light source for designated times and sequences in order to form cycles of somatosensory inputs;

a manual override switch for selectively preventing the light source from commencing illumination during any portion of the cycles of somatosensory inputs; and a reset button for initiating a new cycle of somatosensory inputs in response to manual resetting.

* * * * *